United States Patent [19]

Eley

[11] Patent Number: 4,479,545

[45] Date of Patent: Oct. 30, 1984

[54] WELL-CEMENTING STAGE COLLAR

[76] Inventor: Fred N. Eley, Rte. 1, Box 182B, Gaston, Oreg. 97119

[21] Appl. No.: 437,152

[22] Filed: Oct. 27, 1982

[51] Int. Cl.[3] ..... E21B 33/13

[52] U.S. Cl. ..... 166/318; 166/154

[58] Field of Search ..... 166/317, 318, 154, 316, 166/289, 332, 334, 51, 285; 137/625.33, 625.37

[56] References Cited

U.S. PATENT DOCUMENTS

| | | | |
|---|---|---|---|
| 2,379,079 | 6/1945 | Hayward | 166/154 |
| 2,633,916 | 4/1953 | Baker et al. | 166/155 |
| 2,644,526 | 7/1953 | Lee | 166/318 X |
| 2,988,145 | 6/1961 | Clark, Jr. | 175/317 |
| 2,998,075 | 8/1961 | Clark | 166/318 |
| 3,053,322 | 9/1962 | Kline | 277/34.6 |
| 3,148,731 | 9/1964 | Holden | 166/141 |
| 3,223,159 | 12/1965 | Brown | 166/290 |
| 3,381,756 | 5/1968 | Reagan | 166/319 |
| 3,385,370 | 5/1968 | Knox et al. | 166/317 |
| 3,464,493 | 9/1969 | Chancellor et al. | 166/285 |
| 3,507,325 | 4/1970 | Scott | 166/335 |
| 3,789,926 | 2/1974 | Henley et al. | 166/318 |
| 3,948,322 | 4/1976 | Baker | 166/289 |
| 4,047,566 | 9/1977 | Duke | 166/285 |
| 4,176,717 | 12/1979 | Hix | 166/289 |
| 4,260,017 | 4/1981 | Nelson et al. | 166/154 |

FOREIGN PATENT DOCUMENTS

| | | | |
|---|---|---|---|
| 0663821 | 6/1979 | U.S.S.R. | 166/318 |
| 0702157 | 12/1979 | U.S.S.R. | 166/318 |

*Primary Examiner*—James A. Leppink
*Assistant Examiner*—Michael Starinsky
*Attorney, Agent, or Firm*—Kolisch, Hartwell, Dickinson & Anderson

[57] ABSTRACT

A dual-operating mode stage collar adapted to form part of a conduit string positionable in a well bore. Included is a tubular body having a side port with inner and outer openings. A first sleeve is axially shiftable relative to the body during one operating mode inside the body from one position closing the inner opening toward another position exposing it. A second internal sleeve is connected to an outer-port-closing slide through an aperture in the body and is axially shiftable as a unit relative to the body in a second operating mode from a position in which the slide and second sleeve are remote from the port toward another position in which the slide covers the outer port opening. In the preferred embodiment, the second sleeve covers the inner port opening as the slide covers the outer port opening.

9 Claims, 5 Drawing Figures

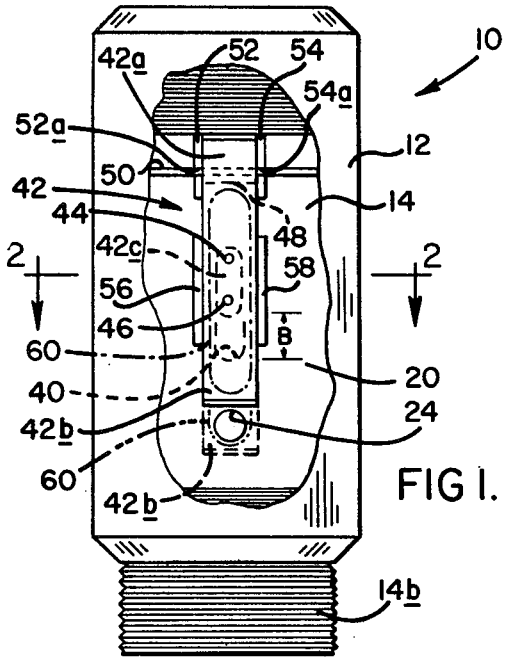
FIG 1.
FIG 2.
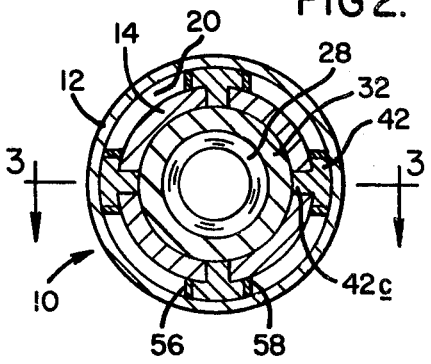
FIG 3.
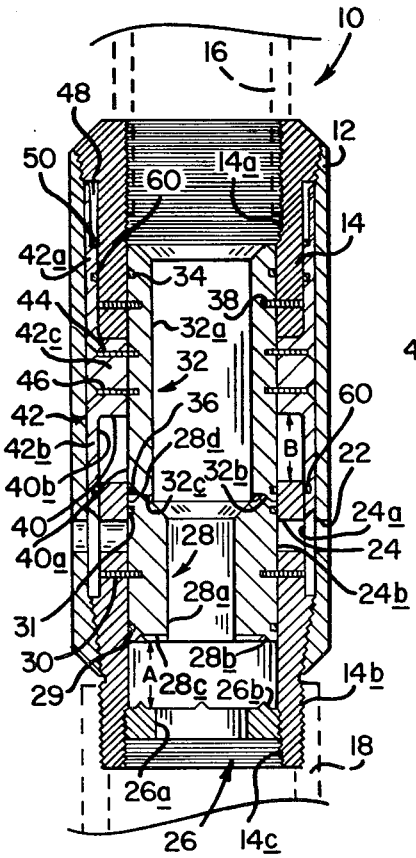
FIG 4.
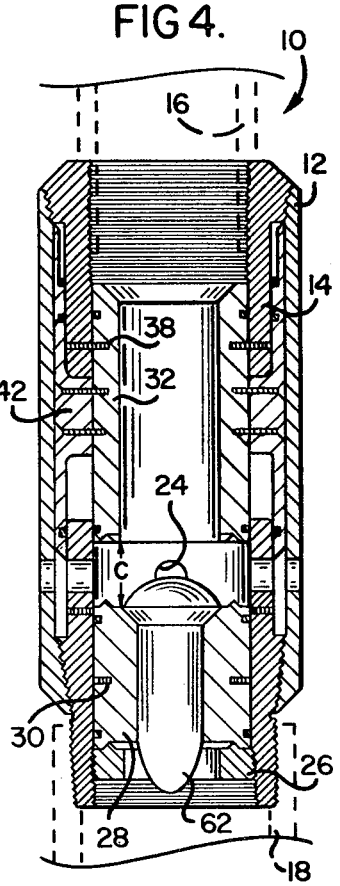
FIG 5.
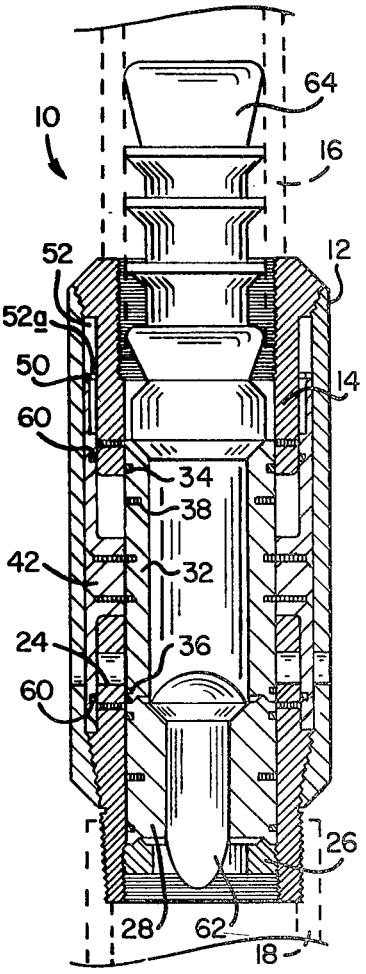

WELL-CEMENTING STAGE COLLAR

BACKGROUND AND SUMMARY OF THE INVENTION

The present invention relates generally to a well-cementing stage collar, and more specifically to such a stage collar operable in two operating modes for initially exposing vent holes prior to a desired cementing operation, and subsequently covering those holes on completion of the cementing operation.

In preparing well bore holes for oil and/or gas production, it is necessary to insert cement into the annular space between the casing and the bore hole. This may be done for various reasons, including isolating undesired regions or, correspondingly, isolating gas or oil production zones. During cementing, a cement slurry is passed down through the casing to critical points, or stages, in the bore hole.

Multiple stage cementing is achieved by placing cementing tools, more commonly referred to as stage collars, at more than one location in the bore hole. The stage collars are selectively operable as valves to provide for the passage of cement through ports located in the collar. Most stage collars include upper and lower sleeves which are slidable inside the collar. The upper sleeve has a larger inner diameter than the lower sleeve.

Typically, both sleeves are initially fastened to the collar by shear pins, with the lower sleeve covering the ports. When cementing is desired, a trip bomb sized to pass through the upper sleeve but not the lower sleeve, is forced down the casing until it seats on the lower sleeve. Sufficient fluid pressure is then applied behind the plug to shear the pins holding the lower sleeve. This moves the lower sleeve down to a point where the cementing ports are uncovered. The bomb forms a block in the casing causing cement slurry then pumped into the casing to pass out the ports into the annulus.

After cementing is completed, a second bomb is passed down the casing until it seats on the upper sleeve. Appropriate fluid pressure is applied behind the plug to shear its pins. This allows the upper sleeve to move down and close off the inside of the ports.

Stage collars of the type just described frequently have operating problems. Among them is the problem of cement slurry in the annulus putting substantial hydrostatic pressure through the ports on the upper sleeve when it is in the closed position, prior to setting of the cement. This can allow cement to seep back into the inside of the casing where it can cause obstacles and even plugs to form when the cement sets. In order to avoid this problem, it is desirable to provide a cover the outside of the port. This has been provided by one device known to applicant in which a hydraulic valve is opened when the second sleeve drops down into position as described above. With this valve open, hydraulic pressure applied inside the casing causes an outside member to shear holding pins and to be hydraulically driven down along the outer wall. If it works properly, this can solve the above-described problem. However, it too can have various operating problems. In order for it to work properly, the second sleeve must properly clear the appropriate valve opening and the limited valve passageway which is typically required may become plugged or obstructed from substances in the well casing. In addition, it requires additional operating costs because it involves a third and separate step prior to setting of the cement in order to accomplish the complete closing operation.

It is therefore a general object of the present inventoin to overcome these disadvantages of the prior art.

Specifically, it is desired to provide a device which is operable in a two-step operation to open the stage collar ports and close them from the outside.

It is an additional objective to provide a collar which simultaneously closes both the inside and outside port openings.

It is a further desired objective to provide a cementing collar which has limited moving parts and is simple to operate either hydraulically or mechanically.

A stage collar made according to the present invention uses an upper and lower internal sliding sleeve to initially open and then close the cementing ports from the inside. Additionally, it includes an outer slide member associated with each port which is attached fixedly to the upper sleeve through appropriate apertures in the collar body. During the port-closing step, the upper inner sleeve and the outer slides slide down unitarily to cover simultaneously the inside and outside of the cementing ports.

It can be seen that such a device provides for simple operation while providing for complete closure of the cementing ports. These and additional objects and advantages of the present invention will be more clearly understood from a consideration of the drawings and the following detailed description of the preferred embodiment.

BRIEF DESCRIPTION OF THE DRAWINGS

FIG. 1 is a partially broken-away side elevation of a stage collar made in conformance with this invention.

FIG. 2 is a cross-sectional view, at a reduced scale, taken along line 2—2 in FIG. 1.

FIG. 3 is a cross-sectional view, not to scale, of the collar of FIG. 2 taken line 3—3 therein showing the collar prior to a cementing operation.

FIG. 4 is a cross-sectional view, similar to that of FIG. 3, showing the collar during a cementing operation.

FIG. 5 is a cross-sectional view, also similar to FIGS. 3 and 4, showing the collar following completion of a cementing operation.

DETAILED DESCRIPTION OF THE INVENTION

Referring initially to FIGS. 1, 2 and 3 and explaining the structure of the preferred embodiment of the present invention, shown generally at 10 is a stage collar having an outer tubular housing 12 which substantially covers an inner tubular body 14. Since a stage collar may be constructed in a large variety of dimensions to accommodate a larger variety of applications and well-casing sizes, no particular dimensions will be described herein. As is well-known in the art, any stage collar must be constructed to comply with industry standard A.P.I. (American Petroleum Institute) ratings.

Body 14 has an inner diameter which conforms, generally, with the inner diameter of the well casing with which it is used. At its upper end, as shown in FIG. 3, are inside threads **14*a* forming a female connection with an upper casing section 16, shown in phantom lines, when placed in a conduit string. The lower end of body 14 has external threads 14*b* and forms a male connection with a lower casing memeber 18, also shown in phantom lines. Collar 10 and attached casings 16, 18** form a portion of a conduit string positionable in a well bore.

As can be seen in viewing FIG. 3, the wall thickness of housing 12 is less at its upper end than its lower end. Correspondingly, the wall thickness of body 14 is less at its lower end than its upper end. This tapered effect provides for positive, limited, engagement between housing 12 and body 14 through associated compatible threads located at the respective upper and lower ends of the two elements, as shown. With housing 12 fixed on body 14, a chamber 20 exists therebetween. This chamber preferably has a uniform width between the two elements for reasons which will shortly be explained. Housing 12 and body 14 each have, in the embodiment shown, four radially directed through-wall side ports such as side ports 22, 24, respectively. Port 24 has what may be considered inner and outer openings, **24*a*, 24*b*, respectively, associated with the inner and outer surfaces of body 14**.

The inside surface of the lower end of body 14 is constructed with left-hand threads **14*c*. A correspondingly left-hand threaded locking nut 26 is screwed into body 14, as shown, to the approximate limit of the threads, the position of which will be described with reference to other parts. The nut is fixed in place with an appropriate locking compound. Nut 26 has a passageway 26*a* extending through it, as shown, with a diameter of sufficient size to allow for passage of a largest-sized trip bomb or other item which may be required to travel therethrough to operate a lower stage collar or similar device. On the top surface of nut 26 are generally pyramid-shaped bosses, such as boss 26*b***.

Disposed above nut 26 within body 14 is what is referred to herein as a lower inner sleeve 28. Sleeve 28 is tubular and has an inner passageway **28*a* which is tapered outwardly at the top and has a minimum diamter which is also large enough to provide clearance for the passing of items therethrough. Sleeve 28 is held in position along body 14 by a plurality of shear pins, such as pin 30, which extends between and into body 14 and sleeve 28**, as shown.

Sleeve 28 also has O-rings 29, 31 distributed circumferentially around its outer surface, as shown, to form a seal around ports 24. Disposed in the lower surface of sleeve 28 are tapered cavities, such as cavity **28*b*, which are sized to conform, radially with bosses 26*b*. Cavities 28*b* are preferrably extended in circumferential direction, so that in this dimension, they are larger than the corresponding dimensions of bosses 26*b***.

Extending between cavities **28*b* and passageway 28*a* is a radially directed groove 28*c* which provides communication between passageway 28*a* and cavity 28*b***.

Disposed on the upper surface of sleeve 28 are bosses **28*d* which are very similar to bosses 26*b***.

Disposed above sleeve 28, and in abutting relationship therewith, is an upper tubular inner sleeve 32. Sleeve 32 also has an inner passageway **32*a* which is tapered outwardly at the top. The minimum diameter of passageway 32*a* must be greater than the minimum diameter of passageway 28*a* for purposes which will subsequently become apparent. Sleeve 32 has in its lower surface adjacent sleeve 28 cavities, such as cavity 32*b*, and grooves, such as groove 32*c*, constructed similar to the corresponding structures on sleeve 28 for mating with bosses 28*d*, as shown. Sleeve 32 also has a pair of O-ring seals 34, 36, disposed adjacent its upper and lower ends, as shown. A plurality of shear pins, such as pin 38, hold sleeve 32 fixedly to body 14**.

Body 14 has an elongate aperture 40 disposed above and longitudinally in line with each port 24. Apertures 40 may also be considered to have inner and outer openings **40*a*, 40*b***, respectively.

Interposed housing 12 and body 14, generally within chamber 20, are slide members or gates, such as slide 42. These slides are generally rectangular and elongate vertically when viewed normal to their outer surface as shown in the break-away portion of FIG. 1. In vertical cross section, as shown in FIG. 3, slide 42 has a general T-shape with upper and lower arms **42*a*, 42*b*, respectively forming the T-crossarm and a thick neck 42*c* forming the stem of the T. Neck 42*c* is slidably disposed in the upper end of aperture 40. Arms 42*a*, 42*b* are slidably between housing 12 and body 14 and have circumferentially spaced, longitudinally extending, generally parallel edges. Slide 42 is fixedly connected to upper sleeve 32 by a pair of countersunk screws 44, 46, extending through neck 42*c*. As is readily apparent, these screws must be strong enough to withstand the forces they will be subjected to during operation of the collar. A known distance B exists between the lower edge of neck 42*c* and the lower edge of aperture 40, which distance is equal to the aforementioned distance A between nut 26 and sleeve 28**.

In the inner side of the distal end of arm **42*a* is a cut-away portion of the arm, identified as hollow 48, providing a clearance between the arm tip and body 14. Disposed circumferentially around body 14 and passing through the lower marginn of hollow 48 is a snap O-ring 50, also referred to as spring-biased lock ring means, which is held under tension against body 14 by arm 42*a***.

Referring specifically to FIGS. 1 and 2, O-ring 50 is shown passing under the distal end of arm **42*a*. A pair of upper guides 52, 54, in the form of metal uprights, extends longitudinally along and is fixedly attached to body 14 paralleling the edges of arm 42*a*, which arm is slidable therebetween. Grooves 52*a*, 54*a*, also referred to as groove means, sized for close but not snug fit receipt of ring 50 exist in guides 52, 54, respectively, as shown. Ring 50 is disposed below the extreme tip or distal end of arm 42*a* a distance just less than the distance B described earlier. A second pair of guides, also referred to as gate-guiding ridges, including guides 56, 58, constructed similar to guides 52, 54 previously described, parallel the intermediate sides of slide 42 generally along the length of aperture 40. As can be seen by viewing FIG. 2, guides 56, 58 extend radially from body 14 and have a thickness generally equal to that of slide arms 42*a*, 42*b*. This thickness is also the distance between body 14 and housing 12 in chamber 20, which distance is appropriate to allow slide 42** to slide in the chamber.

An oblong oval seal 60, shown in dash-dot lines in FIG. 1, is disposed between the underside of slide 42 adjacent body 14. Seal 60 forms a fluid-tight seal therebetween, and in the position shown in FIGS. 1 and 3, generally surrounds aperture 40. Seal 60 extends above neck **42*c* along arm 42*a* a distance greater than the distance B. It extends downward along arm 42*b* and close to the distal end thereof. It can be seen that the distal end of lower arm 42*b* is very close to, but does not cover, any part of outer opening 24*b***.

OPERATION

Describing now the use of collar 10 in a cementing operation, a conduit string, including collar 10 disposed between and connected to an upper casing 16 and a lower casing 18, is disposed in a postion in a well bore where it is desired to cement the annulus between the casing and the well bore. A cementing operation is started with collar 10 structured as has been described with reference to FIGS. 1-3. Initially, a conventional trip bomb 62 is fed down the casing. Bomb 62, being the initial bomb, has a diameter less than the minimum inner diameter of sleeve 32 yet greater than the minimum diameter of sleeve 28. It will be noted in referring to FIG. 4, that passageway 28*a* is sized in such a manner that the corresponding surface of bomb 62 mates with sleeve 28. This forms an essentially fluid-tight seal between these two elements. If bomb 62 is constructed with sufficient weight, it will hit sleeve 28 with sufficient force to shear pins 30. Alternatively, and as is conventionally done, bomb 62 may be flowed in an aqueous slurry until it lodges in sleeve 28. Sufficient hydraulic pressure is then applied to shear pins 30.

Bomb 62 first lodges in sleeve 28 when the sleeve is in the position shown in FIG. 3. After the application of sufficient driving force, as has just been described, for shearing pins 30, sleeve 28 is driven down a distance A against locking nut 26 as shown in FIG. 4. Grooves 28*c* allow cement disposed within cavities 28*b* to escape into the central open region within body 14 when bosses 26*b* are received therein.

Although sleeve 28 travels a relatively short distance during a normally very short time period, it is possible that there may be a slight rotation of sleeve 28 after pins 30 have been sheared prior to seating on nut 26. By having cavities 28*b* extended circumferentially relative to the corresponding shape of bosses 26*b*, a misalignment is corrected since cavities 28*b*, having the described shape, cause sleeve 28 to realign with nut 26 during the seating process.

With sleeve 28 now in the lowered position shown in FIG. 4, a distance C (equal to distances A and B) from sleeve 32, ports 24 are open and communication exists between the internal area of the casing above bomb 62 and the exterior annulus between housing 12 and the well bore via ports 22, 24. Cement is forced down casing 16, into body 14, and out the ports into the surrounding annulus. After completion of the cementing process, it is necessary to close ports 24 in order to prevent the cement slurry from reentering the casing while the cement is setting.

This closing is achieved by shifting the assembly of slide 42 and upper sleeve 32 into its second position during what may be considered a second operating mode for collar 10. A second trip bomb 64 sized to nest on the upper surface of sleeve 32, is sent down the conduit string until it seats on the sleeve. Sleeve 32 is in the position shown in FIG. 4 at the time the bomb first seats against it. With the application of appropriate mechanical or hydraulic pressure to bomb 64, similar to that described for bomb 62, pins 38 are sheared causing sleeve 32 and the adjoining slides 42 to shift downwardly a distance B or C to the postion shown in FIG. 5. In this position, neck 42*c* butts against body 14 at the bottom of aperture 40. Lower slide arm 42*b* extends over outer opening 24*b*. Upper sleeve 32 also covers inner openings 24*a*, as shown. Additionally, each seal 60 extends around the corresponding aperture 40 as well as the corresponding port 24 with which it is associated. Thus, in its final position, slide 42, seal 60 and body 14 cooperate to form a fluid-tight seal around both aperture 40 and port 24. FIG. 1 shows the final positions of the lower section of seal 60 (shown in dash-dot-dot lines) the lower slide arm 42*b* (shown in phantom lines).

During travel of slide 42 in a downward direction, the distal end of upper slide arm 42*a* passes snap-ring 50, thereby releasing it. It expands circumferentially within grooves 52*a*, 54*a* into a position pressing against housing 12. In this position, slide 42 is prevented from moving upward, thereby retaining it in its final position covering port 24. In addition to upper guides 52, 54 and intermediate guides 56, 58, it can be seen that, with the sliding fit between aperture 40 and neck 42*c*, body 14, in forming aperture 40, also serves as guiding means for controlling travel of slide 42.

In its final position, sleeve 32 with O-ring seals 34, 36 form an internal seal around apertures 40 and ports 24. Thus, material is prevented from traveling through port 24 or aperture 40 in either direction in the final positions of sleeve 32 and slide 42.

After the cement slurry has hardened or set, the internal structure of collar 10 is conventionally drilled out in order to establish an internal bore diameter comparable with that of associated casings 16, 18. In this process, it is important that the internal sleeves and the locking nut be unable to rotate as the drill bit is drilling them out. To this end, slide neck 42*c*, in cooperation with apertures 40, keeps sleeve 32 from rotating. In addition, the mating between corresponding bosses and cavities in adjoining surface between nut 26 and sleeve 28, as well as between sleeve 28 and sleeve 32, prevent rotation under the downward force of a drill. A drill bit, conventionally turning to the right, tends to tighten nut 26. Thus, sleeves 28, 32, being interlocked either directly or indirectly with nut 26, are prevented from rotating.

It can therefore be seen, that a stage collar made in conformance with the present invention, as described with reference to the foregoing preferred embodiment, provides the desired advantages and improvements over the prior art. Specifically, during a cementing process, the collar ports are opened by a single movement of the lower sleeve, as is conventionally done. However, by simply applying a second larger bomb to dislodge the upper sleeve, to which is connected an outer slide, both the inner and outer openings to the cementing ports are closed. This invention therefore provides a simple two-step stage collar having a minimum of moving parts which is operable using easily inserted and applied trip bombs as is normally done with conventional double-inner sleeve stage collars. By using shear pins, the ports may be opened and subsequently closed using low internal pressures, determined by the strength of shear pins. Such a collar may be constructed to be applied to any size of casing. Additionally, after drill-out of the internal structure of the collar, necessary seals are provided to prevent leaking from the annulus into the casing.

While the invention has been particularly shown and described with reference to the foregoing preferred embodiment, it will be understood by those skilled in the art that other changes in form and detail may be made therein without departing from the spirit and scope of the invention as defined in the following claims. For instance, it would be possible to use an external sleeve surrounding the tubular body rather than individual slide members, as has been illustrated. Additionally, the collar may be constructed with a shorter upper inner sleeve than that described if it is desired only to close the outer openings of the cementing ports.

It is claimed and desired to secure by Letters Patent:

1. A stage collar adapted to form part of a conduit string positionable in a well bore comprising a tubular body having upper and lower ends and including at least one side port and a corresponding side aperture disposed longitudinally above the port, the port and aperture each having inner and outer openings, an upper inner sleeve disposed slidably on the inside of said body, a gate disposed slidably on the outside of the body and extending partially circumferentially around said body, and a neck extending slidably through the aperture fixedly joining said upper inner sleeve to said gate, said aperture, gate, upper inner sleeve and neck being constructed relative to the port in such a manner that said upper inner sleeve and gate are shiftable, selectively and simultaneously, from an initial position in which both said upper inner sleeve and gate close the inner and outer openings of the aperture, respectively, and are unobstructive substantially of the port, to a second position in which both said upper inner sleeve and gate cover, concurrently and substantially completely, the inner and outer openings, respectively, of the aperture and port.

2. The collar of claim 1, wherein said gate has generally parallel edges extending longitudianlly relative to said body and said body further has a gate-guiding ridge extending longitudinally along and fixedly attached to said body adjacent each of said longitudinally extending gate edges, said ridges being disposed to provide sliding contact with said longitudinally extending gate edges.

3. The collar of claim 1 which further includes sealing means interposed said gate and said body constructed to provide a fluid tight seal around the outer opening of the aperture when said gate is in the initial postion and around the outer openings of both the aperture and the port when said gate is inthe second position.

4. The collar of claim 3, wherein said sealing means includes an O-ring seal extending in a loop around the outer opening of the aperture when the gate is in the initial position and around the outer openings of both the aperture and the port when said gate is in the second position.

5. The collar of claim 1 wherein the aperture has a pair of generally parallel edges extending longitudinally relative to said body and the neck has at least one edge extending generally parallel with, adjacent and in sliding contact with one of the longitudinally extending parallel aperture edges, said neck being constructed in such a manner that the adjacent parallel edges of said neck and aperture are in sliding contact during movement of said gate between the initial and second positions.

6. The collar of claim 1 wherein said gate has an upper arm extending upwardly from where it is joined to said neck, which arm has an upper distal end spaced from said neck, said collar further including spring-biased lock means disposed circumferentially about said body in a generally fixed longitudinal position relative to said body and radially shiftable relative to said body, said body, gate and ring means being constructed to hold said ring means in a spring-biased position unobstructive of said gate during shifting of said gate from the initial to the second position and for preventing return of said gate toward the initial position after the gate has shifted to the second position.

7. The collar of claim 6 wherein said ring means is disposed about said body in circumferentially extending groove means in a position such that said gate restrains said ring means until said gate has shifted into the second position, the distal end of said gate arm being disposed immediately below said ring means when said gate is in the second position, with the passage of the gate upper arm distal end past said ring means allowing the ring means to shift into a gate-blocking position immediately adjacent and above the gate arm distal end.

8. A stage collar adapted to form part of a conduit string positionable in a well bore comprising a tubular body having upper and lower ends and including at least one side port and a corresponding side aperture disposed longitudinally above the port, the port and aperture each having inner and outer openings, a lower inner sleeve disposed slidably on the inside of said body, shiftable selectively from an initial position closing the inner opening of the port to a second position unobstructive of the port, an upper inner sleeve disposed slidably on the inside of said body above said lower inner sleeve, a gate disposed slidably on the outside of the body and extending partially circumferentially around said body, a neck extending through the aperture fixedly joining said upper inner sleeve to said gate, said aperture, gate, upper inner sleeve and neck being constructed relative to the port in such a manner that said upper inner sleeve and gate are shiftable, selectively and simultaneously, from an initial position in which both said upper inner sleeve and gate close the inner and outer openings of the aperture, respectively, and are unobstructive substantially of the port, to a second position in which both said upper inner sleeve and gate cover, concurrently and substantially completely, the inner and outer openings, respectively, of the aperture and port, and sealing means interposed said gate and said body constructed to provide a fluid tight seal aroundd the outer opening of the aperture when said gate is in the initial position and around the outer openings of both the aperture and the port when said gate is in the second position.

9. A stage collar adapted to form part of a conduit string positionable in a well bore comprising a tubular body having upper and lower ends and including at least one side port and a corresponding side aperture disposed longitudinally above the port, the port and aperture each having inner and outer openings, an upper inner sleeve disposed slidably on the inside of said body, a gate disposed slidably on the outside of the body and extending partially circumferentially around said body, a neck extending slidably through the aperture fixedly joining said upper inner sleeve to said gate, said aperture, gate, upper inner sleeve and neck being constructed relative to the port in such a manner that said gate is shiftable selectively from an initial position in which said gate closes the outer opening of the aperture and is unobstructive substantially of the port, to a second position in which said gate covers substantially completely the outer opening of the aperture and port, and sealing means interposed said gate and said body constructed to provide a fluid tight seal around the outer opening of the aperture when said gate is in the initial position and around the outer openings of both the aperture and the port when said gate is in the second position.

* * * * *